US008413269B1

(12) United States Patent
Vail

(10) Patent No.: US 8,413,269 B1
(45) Date of Patent: Apr. 9, 2013

(54) BED ENCLOSURE

(76) Inventor: Robert L. Vail, Oregon, OH (US)

( * ) Notice: Subject to any disclaimer, the term of this patent is extended or adjusted under 35 U.S.C. 154(b) by 183 days.

(21) Appl. No.: 12/967,212

(22) Filed: Dec. 14, 2010

Related U.S. Application Data

(60) Provisional application No. 61/286,612, filed on Dec. 15, 2009.

(51) Int. Cl.
*A47C 29/00* (2006.01)
*A61G 7/05* (2006.01)

(52) U.S. Cl. ..... 5/414; 5/424; 5/663

(58) Field of Classification Search ..... 5/97, 113, 5/414, 424, 663
See application file for complete search history.

(56) References Cited

U.S. PATENT DOCUMENTS 5,384,925 A 1/1995 Vail
5,784,732 A 7/1998 Vail
6,216,291 B1 * 4/2001 Eads et al. ..... 5/424
6,401,281 B1 * 6/2002 Younge ..... 5/663
6,487,735 B1 12/2002 Jacques, II et al.
6,694,547 B1 2/2004 Vail
7,047,991 B2 5/2006 Kline
7,380,296 B2 * 6/2008 Ellen et al. ..... 5/424
7,383,849 B2 6/2008 Kline
7,430,770 B2 * 10/2008 Ramirez ..... 5/424
7,434,280 B2 10/2008 Cyr
7,735,167 B2 6/2010 Kline et al.

* cited by examiner

*Primary Examiner* — Michael Trettel
(74) *Attorney, Agent, or Firm* — MacMillan, Sobanski & Todd, LLC

(57) ABSTRACT

According to one embodiment a bed enclosure comprises a frame including a plurality of side posts and upper frame members connected to the side posts. The frame defines a pair of opposed ends, opposed sides and a top of the bed enclosure. At least one cover member is provided and covers the opposed ends, opposed sides and the top of the bed enclosure. The at least one cover members includes a flap portion which wraps around and covers a portion of one of the upright side posts and upper frame members and is secured therearound so as to prevent access around the at least one of the upright side posts and upper frame members which is covered by the flap portion.

21 Claims, 14 Drawing Sheets

BED ENCLOSURE

CROSS-REFERENCE TO RELATED APPLICATIONS

This application claims the benefit of U.S. Provisional Application Ser. No. 61/286,612, filed Dec. 15, 2009.

BACKGROUND OF THE INVENTION

This invention relates generally to bed enclosures and in particular to improvements which can be used with such bed enclosures.

In some medical treatment situations, it is sometimes necessary (or preferred) to physically restrain certain patients in order to provide protection for themselves and/or others. For example, adults and children having dementia, psychiatric or mental disorders, or other kinds of mental and/or physical problems may need to be restrained. In the past, these people have been physically restrained by using ties, straps, or vests. However, the use of these kinds of restraints can cause psychological and physical harm, can cause severe discomfort, and can impede emergency treatment. In addition, these kinds of restraints must frequently be removed during the day for a variety of reasons, such as to allow the person to exercise his or her muscles, or to clean or feed the person.

One alternative to using physical restraints involves using a bed enclosure. Typically, the bed enclosure includes a supporting framework and a netted covering which is fitted over the sides and top of the framework. The netted covering is provided with zippered areas which can be readily opened and closed in order to provide access to the interior of the enclosure. Thus, the bed enclosure provides a more humane, safe, and less restrictive environment for the person. One example of such a bed enclosure is disclosed in U.S. Pat. No. 5,384,925 to Vail.

SUMMARY OF THE INVENTION

This invention relates to bed enclosures and improvements that can be used therewith. According to an embodiment, a bed enclosure comprises a frame including a plurality of side posts and upper frame members connected to the side posts, the frame defining a pair of opposed ends, opposed sides and a top of the bed enclosure; and at least one cover member covering the opposed ends, opposed sides and the top of the bed enclosure; wherein the at least one cover member includes a flap portion which wraps around and covers a portion of one of the upright side posts and upper frame members and is secured therearound so as to prevent access around the at least one of the upright side posts and upper frame members which is covered by the flap portion.

According to another embodiment, the at least one cover member includes a plurality of flap portions which are operative to wrap around and cover portions of all of the upright side posts and be secured therearound so as to prevent access around the upright side posts which are covered by the flap portions.

According to another embodiment, the at least one cover member includes a plurality of flap portions which are operative to wrap around and cover portions of all of the upper frame members and be secured therearound so as to prevent access around the upper frame members which are covered by the flap portion.

According to another embodiment, a plurality of cover members are provided and the plurality of cover members include a plurality of flap portions which are operative to wrap around and cover portions of all of the upright side posts and all of the upper frame members and be secured therearound so as to prevent access around the upright side posts and the upper frame members which are covered by the flap portions.

According to another embodiment, the at least one cover member includes a separate top cover member, a pair of separate side cover members and a pair of separate end cover members all releasably connected together, and wherein at least one of the top, side and end cover members includes a plurality of flap portions which are operative to wrap around and cover portions of all of the upright side posts and all of the upper frame members and be secured therearound so as to prevent access around the upright side posts and the upper frame members which are covered by the flap portions.

According to another embodiment, the bed enclosure further includes at least one padding member disposed inside of and covered by at least a portion of the at least one flap portion.

According to another embodiment, the at least one padding member is generally U-shaped and covers two upright side posts and one upper frame member connecting the two upright side posts together.

According to another embodiment, the at least one padding member includes a flap member provided at each of a pair of upper corners thereof, the flap member adapted to be releasably fastened to a portion of the at least one padding member.

According to another embodiment, the at least one cover member includes a plurality of flap portions which are operative to wrap around and cover portions of all the upright side posts and all the upper frame members and be secured therearound so as to prevent access around the upright side posts and the upper frame members which are covered by the plurality of flap portions, and wherein the bed enclosure further includes a plurality of padding members disposed inside of and covered by the plurality of flap portions.

According to another embodiment, the bed enclosure further includes a mattress cover releasably attached to the at least one cover member so as to prevent access therethough.

According to another embodiment, the at least one cover member includes a pair of separate side cover members and a pair of separate end cover members and wherein the mattress cover is releasably attached to lower portions of the side cover members and the end cover members.

According to another embodiment, the mattress cover is provided with a split flap having opposed ends which are adapted to extend around an associated side post of the bed enclosure and are releasably secured together therearound.

According to another embodiment, the opposed ends of the flap portion are provided with fastening members provided thereon which are adapted to be fastened together.

According to another embodiment, the at least one cover member includes a separate top cover member, a pair of separate side cover members and a pair of separate end cover members all releasably connected together by zippers.

According to another embodiment, a plurality of flap portions are provided on at least one of the separate top cover member, pair of separate side cover members and pair of separate end cover members, the flap portions operative to wrap around and cover portions of all the upright side posts and all the upper frame members and be secured therearound so as to prevent access around the upright side posts and the upper frame members which are covered by the plurality of flap portions.

According to another embodiment, the bed enclosure further includes a lower bed support frame assembly.

According to another embodiment, the lower bed support frame assembly is non-adjustable.

According to another embodiment, the at least one cover member includes an access panel.

According to another embodiment, the bed enclosure comprises: a frame including side posts and upper frame members connected to the side posts, the frame defining a pair of opposed ends, opposed sides and a top of the bed enclosure; at least one cover member covering at least one of the opposed ends, opposed sides and the top of the bed enclosure; and means carried by the at least one cover member which wraps around and covers a portion of one of the side posts and upper frame members and is secured therearound so as to prevent access therearound.

According to another embodiment, an apparatus for a bed enclosure, the bed enclosure having a frame including a plurality of side posts and upper frame members connected to the side posts, the frame defining a pair of opposed ends, opposed sides and a top of the bed enclosure; the apparatus comprises: at least one cover member configured to cover at least one of the opposed ends, opposed sides and the top of the bed enclosure; and means carried by the at least one cover member which wraps around and covers a portion of one of the upright side posts and upper frame members and is secured therearound so as to prevent access therearound.

According to another embodiment, a bed enclosure comprises a frame including a plurality of side posts and upper frame members connected to the side posts, the frame defining a pair of opposed ends, opposed sides and a top of the bed enclosure; at least one cover member covering the opposed ends, opposed sides and the top of the bed enclosure; and at least one generally U-shaped padding member which covers two upright side posts and one upper frame member connecting the two upright side posts together.

According to another embodiment, a bed enclosure comprises a frame including a plurality of side posts and upper frame members connected to the side posts, the frame defining a pair of opposed ends, opposed sides and a top of the bed enclosure; at least one cover member covering the opposed ends, opposed sides and the top of the bed enclosure; and a mattress cover releasably attached to the at least one cover member.

DETAILED DESCRIPTION OF THE INVENTION

Figure 1:
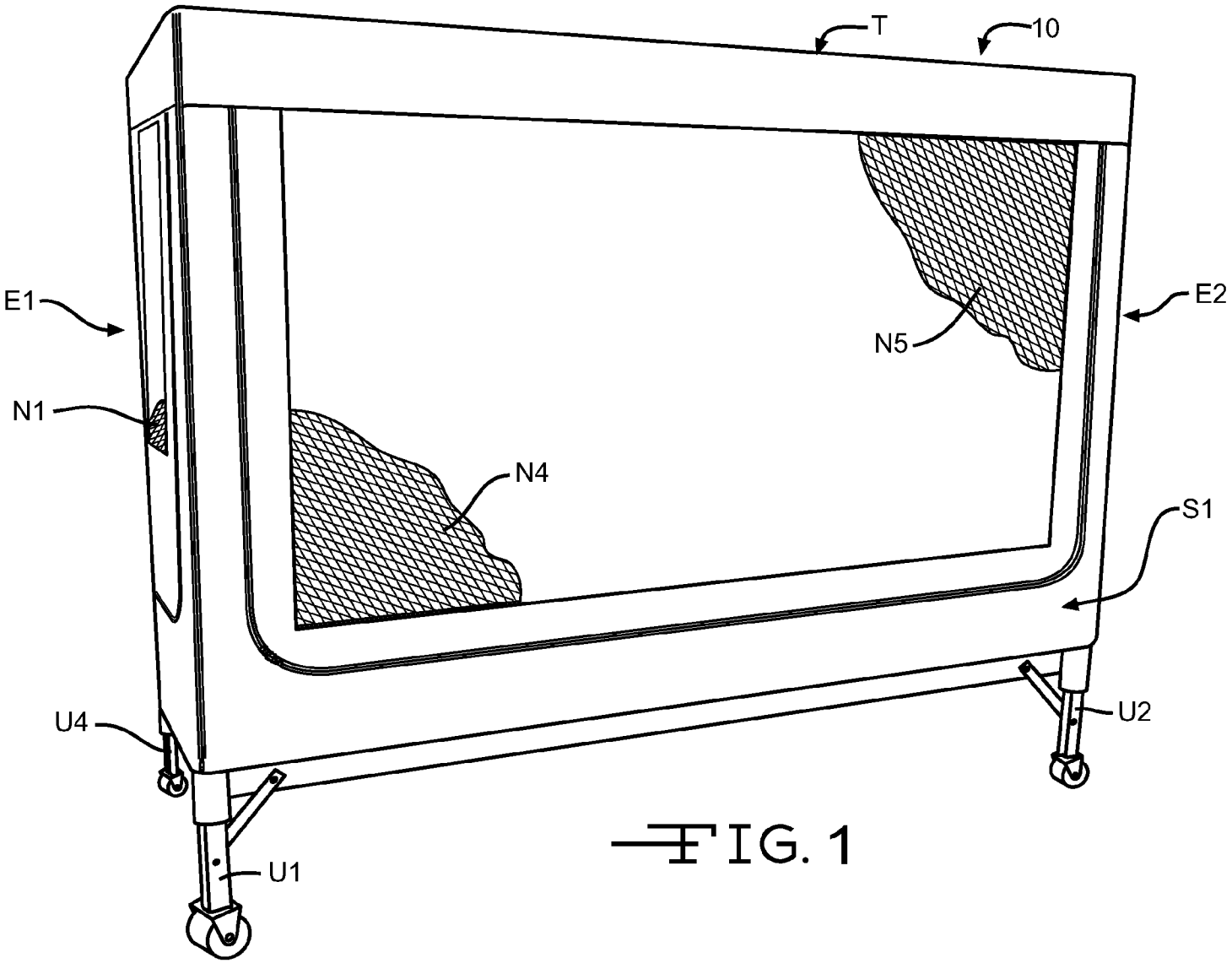
FIG. 1 is a side view of an embodiment of a bed enclosure constructed in accordance with the present invention.
Figure 2:
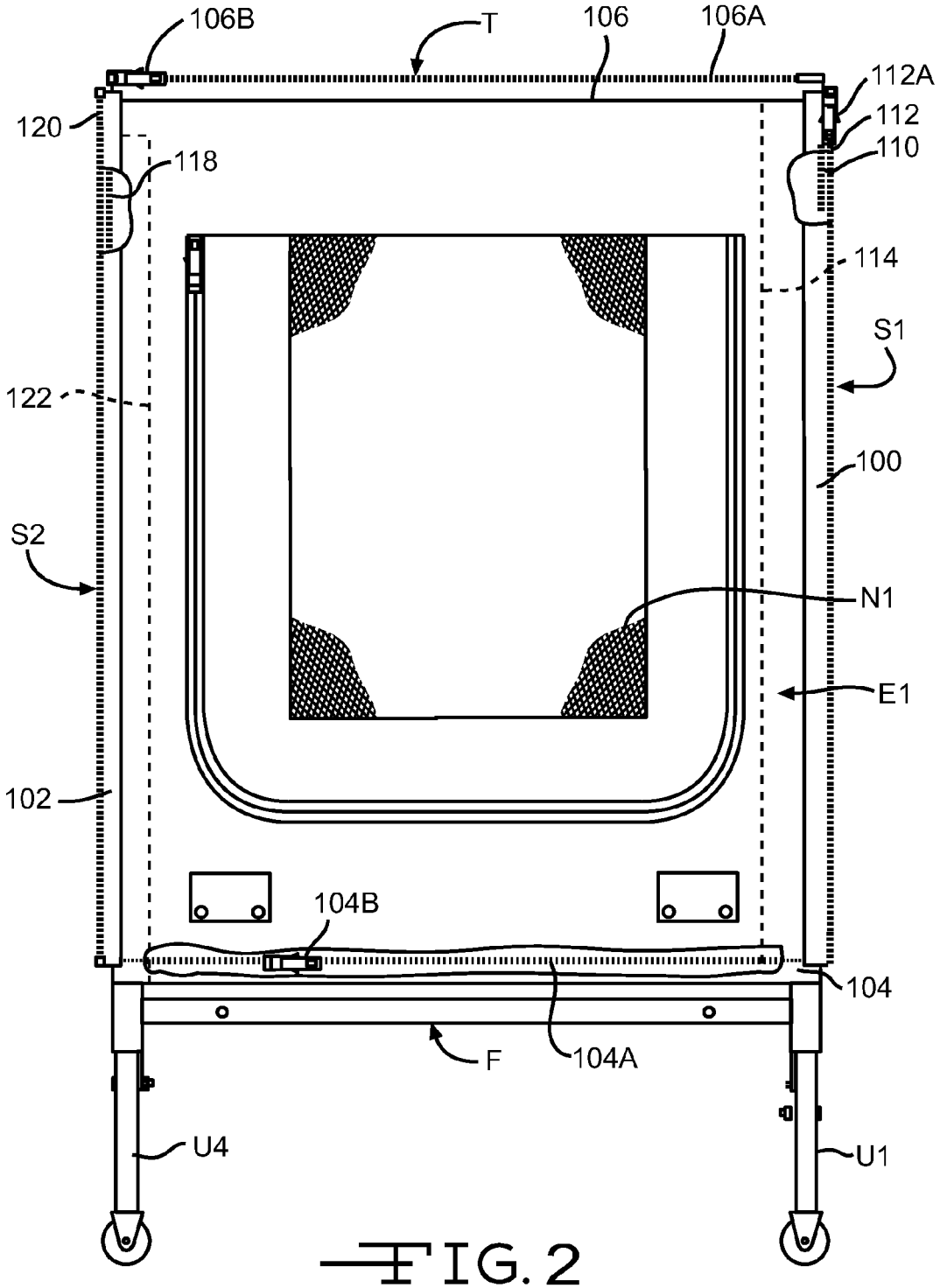
FIG. 2 is an end view of the bed enclosure illustrated in FIG. 1.

Referring now to the FIGS. 1 and 2, there is illustrated an embodiment of a bed enclosure, indicated generally at 10, constructed in accordance with the present invention. The remaining drawings, namely FIGS. 3-12, illustrate selected portions and/or components of the bed enclosure 10 and the unique embodiments and/or features thereof one or more of which can be used in connection with the present invention as will be discussed below in detail. The general structure and operation of the bed enclosure 10 is known in the art and only those portions which are necessary to understand the present invention will be discussed. Also, although the present invention is illustrated and described in conjunction with the particular bed enclosure construction disclosed herein, it will be appreciated that the invention may be used in conjunction with other types of bed enclosures, if so desired. For example, as shown herein or with modifications thereto, the present invention may be used in connection with other associated bed enclosures, such as shown for example shown in U.S. Pat. No. 5,384,925 to Vail, U.S. Pat. No. 5,784,732 to Vail, and/or U.S. Pat. No. 6,694,547 to Vail, the disclosures of all of these patents incorporated by reference herein in their entirety.

Figure 3:
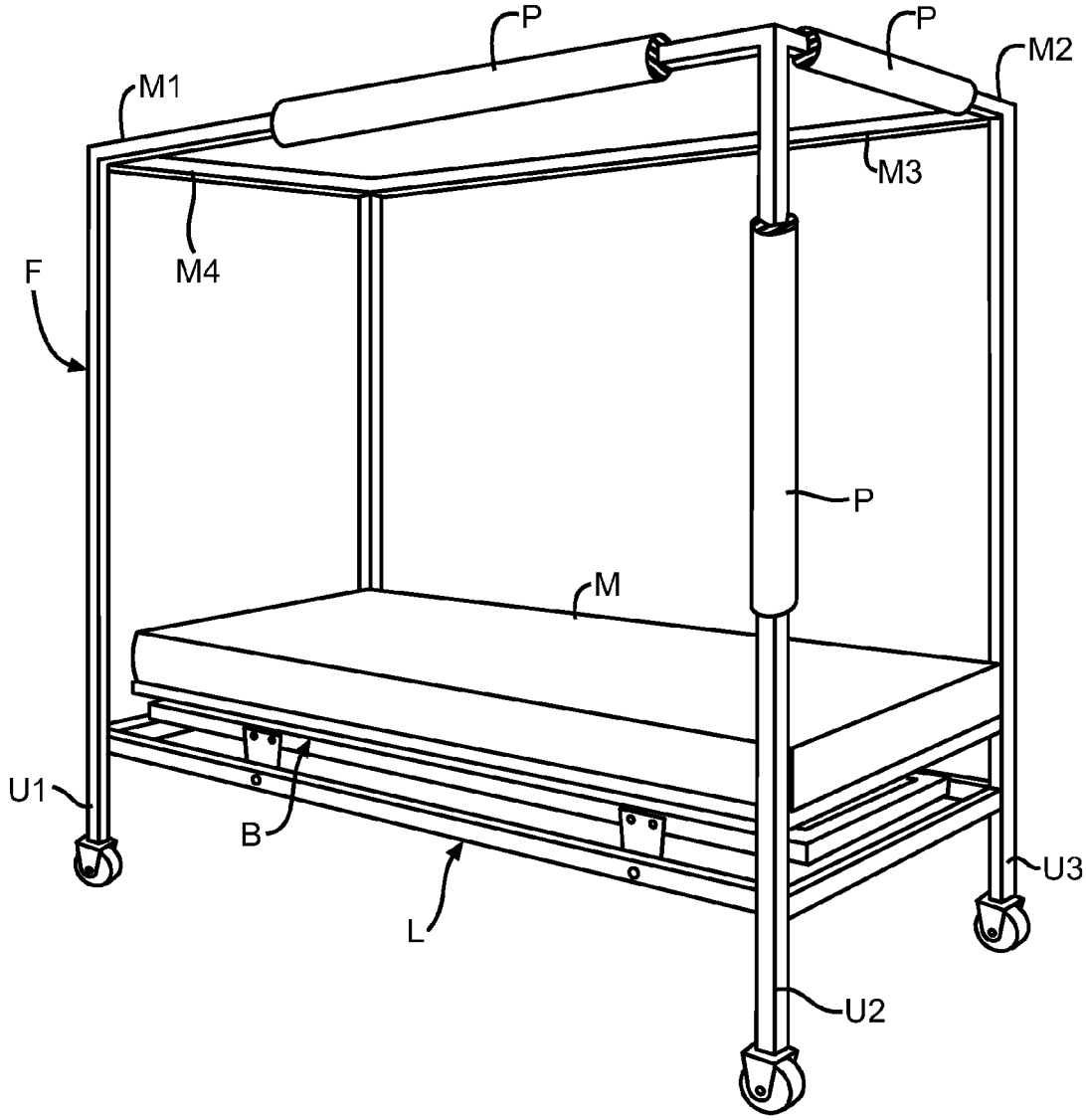
FIG. 3 is a view of the bed enclosure illustrated in FIGS. 1 and 2 showing only the bed enclosure and the mattress thereof.

In the illustrated embodiment, the bed enclosure 10 is generally similar to the bed enclosure shown in the Vail '925 patent in that the bed enclosure 10 includes a "base" frame, indicated generally at F and best shown in FIG. 3, having four upright or "vertical" side posts or members U1-U4 and four upper "horizontal" posts or members M1-M4. The frame F of the bed enclosure 10 further includes a lower bed support frame assembly, indicated generally at L, a bed, indicated generally at B, which is secured to the lower bed support frame assembly L, and a mattress M, which rests upon the bed B. In the illustrated embodiment, the lower bed support frame assembly L is illustrated as being a fixed frame, i.e., non-adjustable. Alternatively, the construction of the frame F of the bed enclosure 10 can be other than illustrated and described if so desired. For example, the lower bed support frame assembly L can be of an adjustable design if so desired.

As shown best in FIGS. 1 and 2, in the illustrated embodiment the bed enclosure 10 includes a pair of "end" cover or netting members N1 and N2 provided on respective ends E1 and E2 thereof; a "top" cover or netting member N3 (shown in FIG. 6) provided on a top T thereof, and a pair of "side" cover or netting members N4 and N5 provided on respective sides S1 and S2 thereof. Preferably, in the illustrated embodiment the end cover members N1 and N2 and the side cover members N4 and N5 are each provided with a generally centrally located zippered and netted "access" opening or panel and the top cover member N3 is provided with a generally centrally located netted panel. The cover members N1-N5 and their associated construction and operation will be discussed below in detail below.

Figure 4:
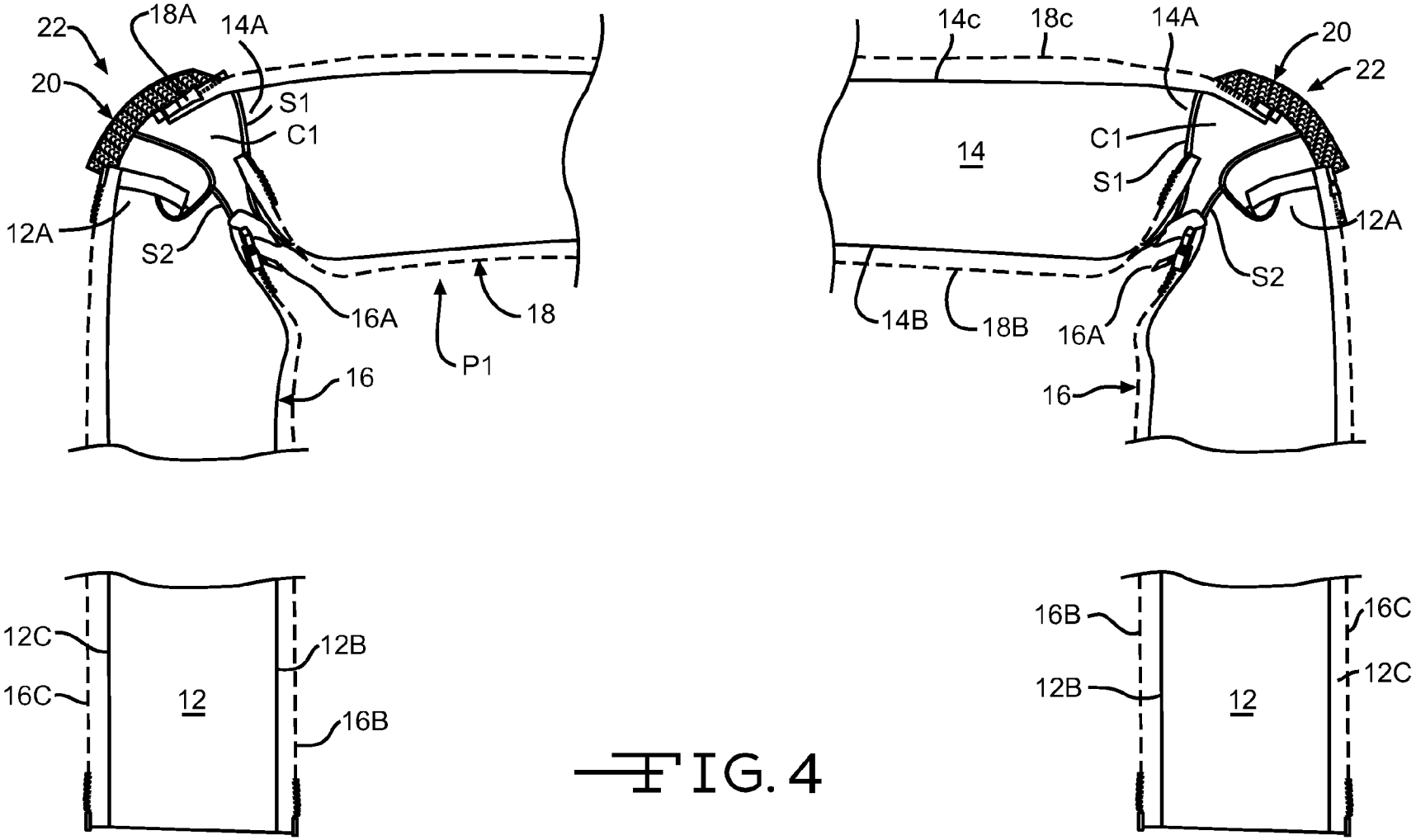
FIG. 4 is a view of an embodiment of a first padding cover member adapted for use with the bed enclosure illustrated in FIGS. 1 and 2.
Figures 5A, 5B:
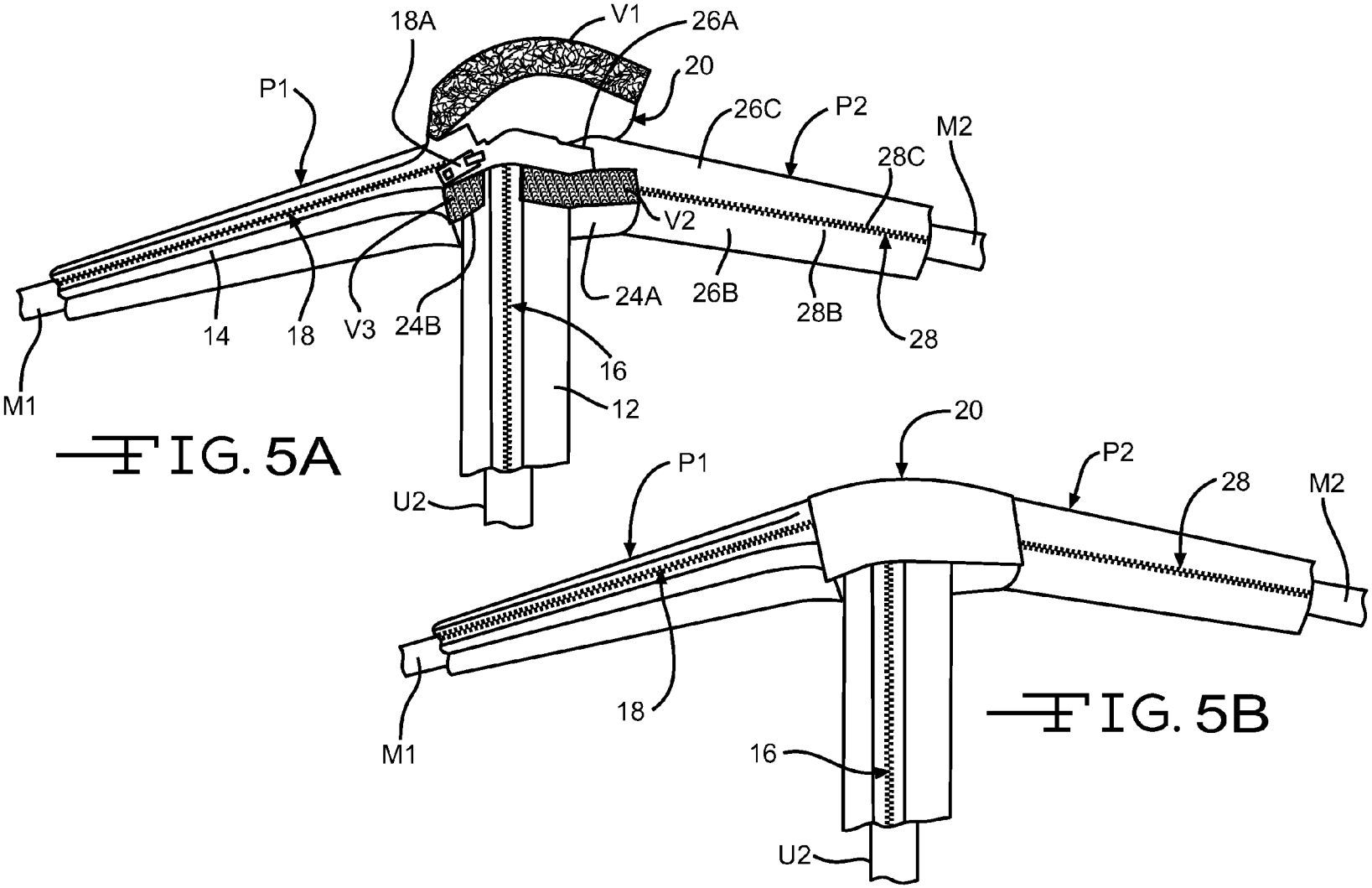
FIGS. 5A and 5B are views of a portion of the bed enclosure illustrated in FIGS. 1 and 2 and showing the first padding cover member and an embodiment of a second padding cover member installed thereon.

As shown in FIGS. 4, 5A and 5B, according to one embodiment of the invention it can be appreciated that the side posts U1-U4 and the upper members M1-M4 are preferably covered or wrapped by one of an associated pair of first "padding" cover members, indicated generally at P1, and one of an associated pair of second "padding" cover members, indicated generally at P2, in accordance with the present invention.

One of the pair of the first padding cover members P1 is best shown in FIG. 3. In the illustrated embodiment, the first padding cover members P1 are preferably provided to cover a pair of the upright posts U1 and U2 or U3 and U4, along with an associated "long side" upper member M1 or M3, respectively, of the bed enclosure 10. In the illustrated embodiment, each of the first padding cover members P1 is generally U-shaped and includes a pair of opposed "vertical" side cover members 12 and a "horizontal" top cover member 14. In the illustrated embodiment, an upper end 12A of each of the side cover members 12 is connected or joined to an associated end 14A of the top cover member 14 by suitable means. In the illustrated embodiment, this is accomplished by a piece of a covering material C1, which is connected to the associated ends 12A and 14A by suitable means, such as for example sewing or stitching as illustrated in FIG. 3 by reference characters S1 and S2. Alternatively, the upper end 12A of each of the side cover members 12 can be connected or joined to the associated end 14A of the top cover member 14 by other suitable means, if so desired. Preferably, the piece of covering material C1, the sides 12 and the top cover member 14 are formed from a suitable material, such as for example vinyl, plastic, cloth, fabric or any outer suitable and/or similar kind of desired covering material.

As best shown in FIG. 3, each of the side cover members 12 is includes a pair of opposed sides 12B and 12C. Each of the side cover members 12 is provided with a zipper, indicated generally at 16, having a zipper slider pull tab 16A. The zipper 16, as well as all the other zippers discussed below in detail, is preferably a separate cloth or fabric member provided with the associated zipper teeth thereon and which is attached to the associated cover member, padding member and/or mattress cover of the bed enclosure 10 by sewing, stitching or other suitable means. The zipper 16 includes "mating" zipper teeth 16B and 16C which are provided on the sides 12B and 12C, respectively, of the side cover member 12.

The top cover member 14 includes a pair of opposed sides 14B and 14C. The top cover member 14 is provided with a zipper, indicated generally at 18, having a zipper slider pull tab 18A. The zipper 18 includes "mating" zipper teeth 18B and 18C which are provided on the sides 18B and 18C, respectively, of the top cover member 14.

In the illustrated embodiment, the first padding member P1 is preferably further provided with a "flap" or cover member portion, indicated generally 20, at each of opposed upper corners 22 thereof. The flap 20 is preferably formed from the same material as the piece of the covering material C1, the sides 12 and the top cover member 14 to which it is connected by suitable means, such as for example sewing or stitching. In the illustrated embodiment, the flap 20 is preferably releasably secured or fastened to the side 12 and the top cover member 14 to hide or conceal the upper corners 22 of the first padding member P1, zipper slider pull tabs and provided on the first and second padding members (only zipper slider pull tab 18A of the first padding member P1 being shown in FIG. 5A), along with an associated end 26A of the second padding cover members P2. To accomplish this in the illustrated embodiment, the flap 20 is preferably releasably fastened to separate cover material portions 24A and 24B of the side cover member 12 and the side cover member 12/top cover member 14 by suitable means, such as for example, hook and loop fastening, i.e., Velcro.

As can be seen best in FIG. 5A, an underside of the flap 20 is provided with a loop portion V1 and the portions 24A and 24B of the side cover member 12 and the side cover member 12/top cover member 14 are each provided with a hook portion V2 and V3, respectively. As can be seen best for example in FIG. 5B, when the flap 20 is properly secured via the hook and loop fastening thereof, it is effective to cover or conceal not only the associated upper end 12A of the side cover member 12 but also the associated zipper slider pull tabs of the first and second padding members along with an associated adjacent end 14A of the top cover member 14 and an end 26A of the second padding member P2. As can be seen in FIG. 5B, the end 14A of the top cover member 14 and the end 26A of the second padding member P2 are each preferably tucked under and concealed underneath the portions 24B and 24A, respectively of the flap 20. Alternatively, the construction of one or both of the pair of the first padding cover members P1 can be other than illustrated and described if so desired.

In the illustrated embodiment, each of the pair of second padding cover members P2, one of which is partially shown in FIGS. 5A and 5B in its installed position, is preferably formed from a vinyl, plastic, cloth, fabric or any outer suitable and/or similar kind of desired covering material, and are provided to cover each of the "short ends" of the upper members M2 and M4 of the bed enclosure. Each of the second padding cover members P2 includes a pair of opposed sides 26B and 26C. Each of the second padding cover members P2 is provided with a zipper, indicated generally at 28, having a zipper slider pull tab 28A. The zipper 28 includes "mating" zipper teeth 28B and 28C which are provided on the sides 26B and 26C, respectively, of the second padding member P2, and a zipper slider pull tab (not shown). Alternatively, the construction of one or both of the pair of the second padding cover members P2 can be other than illustrated and described if so desired.

Preferably, in the illustrated embodiment, there is provided a "inner" foam or similar kind of a padding or cushioning material (portions of which are partially shown in FIG. 3 at P), which is disposed on or wrapped around the side posts U1-U4 and the upper members M1-M4 prior to the installation of the first padding cover members P1 and the second padding cover members P2 thereon.

Figure 6:
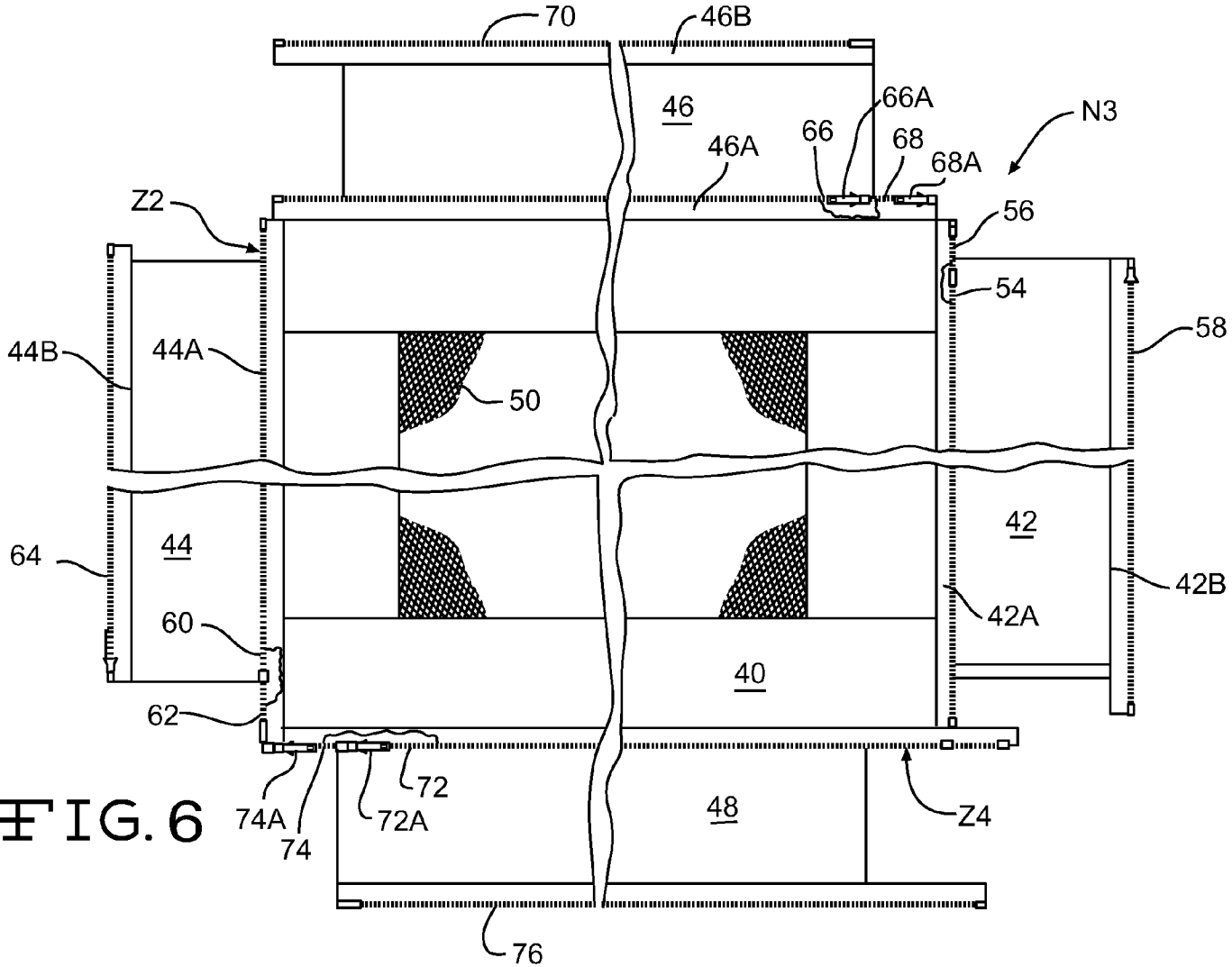
FIG. 6 is a view of an embodiment of a top cover member used on the bed enclosure illustrated in FIGS. 1 and 2.

Referring now to FIG. 6, there is illustrated an "inner" or "inside" view of the top cover member N3 in accordance with an embodiment of the present invention. As shown therein, the top cover member N3 includes a center or middle cover portion 40 and a first pair of opposed "short" end cover members or flap portions 42 and 44 and a second pair of opposed "longer" side cover members or flap portions 46 and 48. The center cover portion 40, the end cover portions 42 and 44 and the side cover portions 46 and 48 are all preferably formed from a similar covering material, such as for example vinyl, plastic, cloth, fabric or any outer suitable and/or similar kind of desired covering material. Also, the center cover portion 40 is preferably connected to the end cover portions 42 and 44 and the side cover portions 46 and 48 by suitable means, such as for example sewing or stitching. Alternatively, the connections of the center cover portion 40 to the end cover portions 42 and 44 and the side cover portions 46 and 48 may be other suitable means if so desired. As shown in the illustrated embodiment, the center cover portion 40 is preferably provided with a generally centrally located netting 50 disposed therein.

Figure 7:
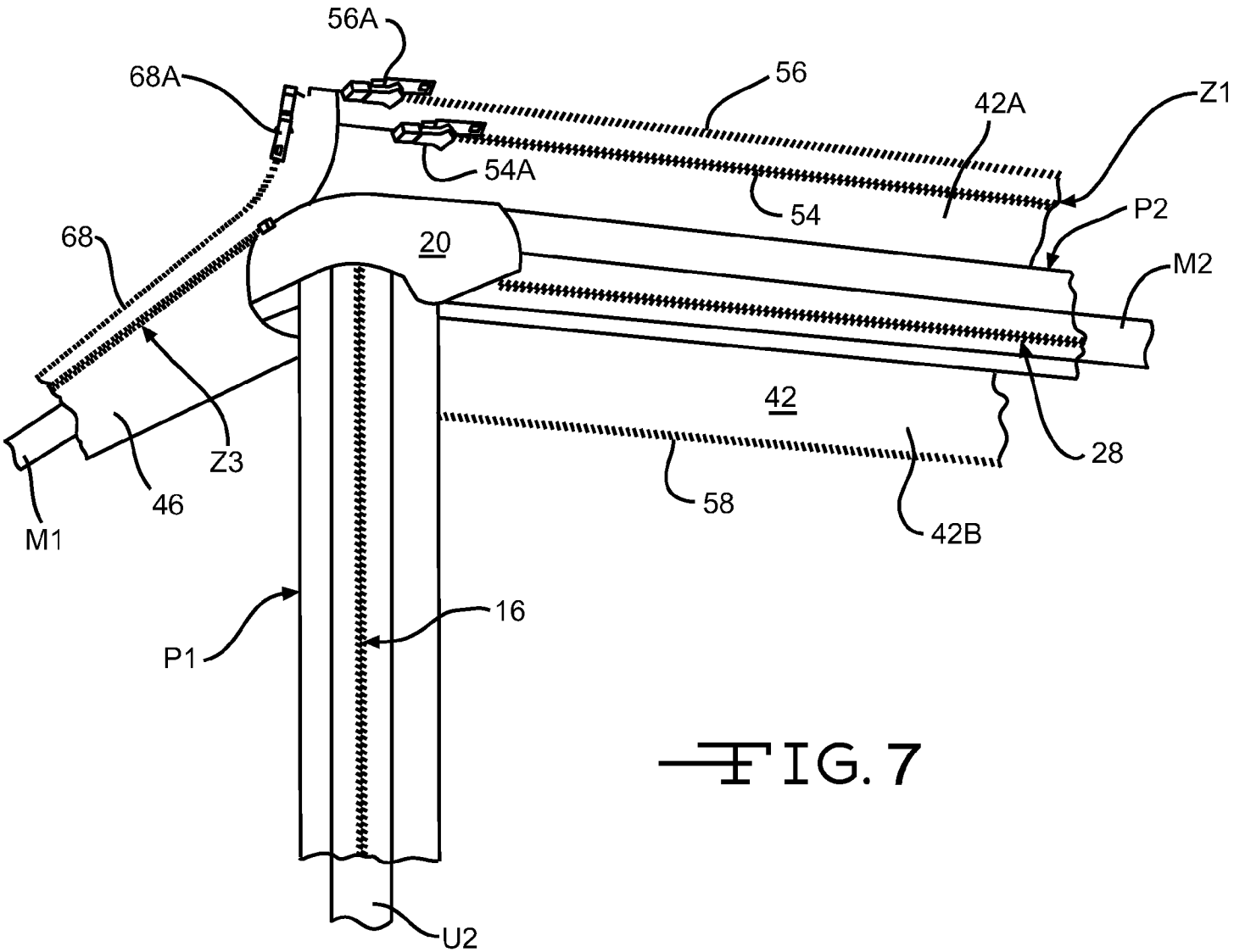
FIG. 7 is a view of a corner of the bed enclosure illustrated in FIGS. 1 and 2 and showing the first and second padding cover members installed thereon and the top cover member thereon.

As shown in FIGS. 6 and 7, the end member 42 includes an inner or first side 42A and an outer or second side 42B. In the illustrated embodiment, the inner side 42A of the end member 42 includes a pair of spaced apart zipper teeth, namely an "inner" or first zipper teeth 54 and an "outer" or second zipper teeth 56, a zipper slider pull tab 54A and a zipper slider pull tab 56A. The outer side 42B includes zipper teeth 58. As will be discussed, the inner zipper teeth 54 of the inner side 42A in cooperation with the zipper teeth 58 of the outer side 42B define an inner or "first" zipper Z1.

Similarly, the opposite end member 44 includes an inner or first side 44A and an outer or second side 44B. In the illustrated embodiment, the inner side 44A of the end member 44 includes a pair of spaced apart zipper teeth, namely an "inner" or first zipper teeth 60 and an "outer" or second zipper teeth 62 each having a zipper slider pull tab provided thereon (not shown). The outer side 44B includes zipper teeth 64. As will be discussed, the inner zipper teeth 60 of the inner side 44A in cooperation with the zipper teeth 64 of the outer side 44B define an "inner" or second zipper Z2.

As shown in FIGS. 6 and 7, the side cover member 46 includes an inner or first side 46A and an outer or second side 46B. In the illustrated embodiment, the inner side 46A of the side cover member 46 includes a pair of spaced apart zipper teeth, namely an "inner" or first zipper teeth 66 and an "outer" or second zipper teeth 68. The inner zipper teeth 66 have a zipper slider pull tab 66A and the outer zipper teeth 68 have a zipper slider pull tab 68A. The outer side 46B includes zipper teeth 70. As will be discussed, the inner zipper teeth 66 of the inner side 46A in cooperation with the zipper teeth 70 of the outer side 46B define an "inner" or third zipper Z3.

Similarly, the opposite side cover member 48 includes an inner or first side 48A and an outer or second side 48B. In the illustrated embodiment, the inner side 48A of the side cover member 48 includes a pair of spaced apart zipper teeth, namely an "inner" or first zipper teeth 72 and an "outer" or second zipper teeth 74. The inner zipper teeth 72 have a zipper slider pull tab 72A and the outer zipper teeth 74 have a zipper slider pull tab 74A. The outer side 48B includes zipper teeth 76. As will be discussed, the inner zipper teeth 72 of the inner side 48A in cooperation with the zipper teeth 76 of the outer side 48B define an "inner" or fourth zipper Z4.

In use, the once the top cover member N3 is properly positioned on the top T of the bed enclosure 10 preferably already having the first and second padding cover members P1 and P2 installed thereon, the "inner" zipper slider pull tab 54A provided on the end member 42 of the top netting member N3 is operable to move up and down the teeth 54 and 58 provided thereon to close the first or inner zipper Z1 formed by such mating teeth 54 and 58 and thereby secure the end member 42 of the top cover member N3 preferably tightly or snugly around the upper end member M2 of the bed enclosure 10. As can be readily understood, the opposite end member 44 as well as the side cover members 46 and 48 are similarly installed and secured about the upper end member M4 and upper side cover members M1 and M3, respectively, by utilizing their associated "inner" zippers Z2, Z3 and Z4. Alternatively, the configuration and/or the construction of the top cover member N3 can be other than illustrated and described, if so desired.

For example, which of the associated zipper teeth provided on the portions 42, 44, 46 and 48 of the top cover member N3 have or do not have an associated zipper slider pull tab can be other than illustrated and described depending on which of the associated other mating teeth provided on the associated cover members N2, N1, N4 and N5 that the portions 42, 44, 46 and 48 are zippered to either have or do not have a zipper slider pull tab associated with their respective zippers. Thus, in the illustrated embodiment it can be understood that one of the associated mating teeth provided on the portions 42, 44, 46 and 48 or the cover members N2, N1, N4 and N5 needs to have a zipper slider pull tab provided thereon in order to zip together and connect the portions 42, 44, 46 and 48 to the associated cover members N2, N1, N4 and N5.

Figure 8:
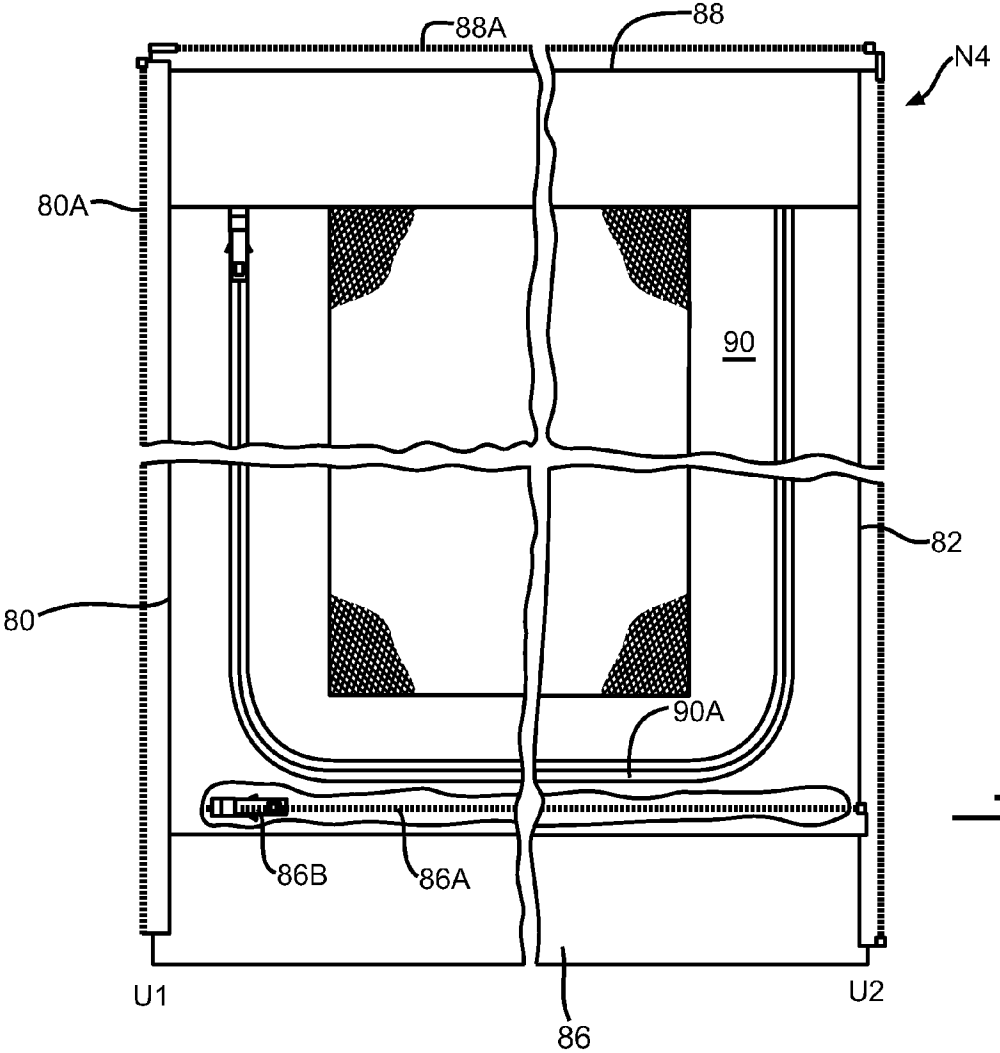
FIG. 8 is a view of an embodiment of a side cover member used on the bed enclosure illustrated in FIGS. 1 and 2.

Referring now to FIG. 8, there is illustrated a "outer" or "outside" view of one of the pair of side cover members N4 and N5, namely side cover member N4. As shown therein, in the illustrated embodiment the side cover member N4 includes a first "vertical" side 80, a second "vertical" side 82, a lower "horizontal" side 86, and an upper "horizontal side 88. In the illustrated embodiment, the first side 80 is provided with zipper teeth 80A and the second side 82 is provided with zipper teeth 82A.

The lower side 86 is provided with zipper teeth 86A and a zipper pull slider tab 86B. In the illustrated embodiment, the zipper teeth 86A are provided on the inside of the cover member N4 and are located below a lower portion 90A of a zippered netted access panel 90 provided therein. The upper side 88 is provided with zipper teeth 88A.

As can be understood, the opposite side cover member N5 can have the same construction as that of the side cover member N4. Alternatively, the construction and/or configuration of one or both of the side cover members N4 and N5 can be other than illustrated and described, if so desired. For example, which of the associated zipper teeth of the side cover members N4 and/or N5 are provided with a zipper slide pull tab can be other than illustrated and described if so desired depending upon which of the associated zipper teeth of the end cover members N1 and N3 and the top cover member N3 zipper teeth either have or do not have an associated zipper slider pull tab provided thereon.

Figure 9:
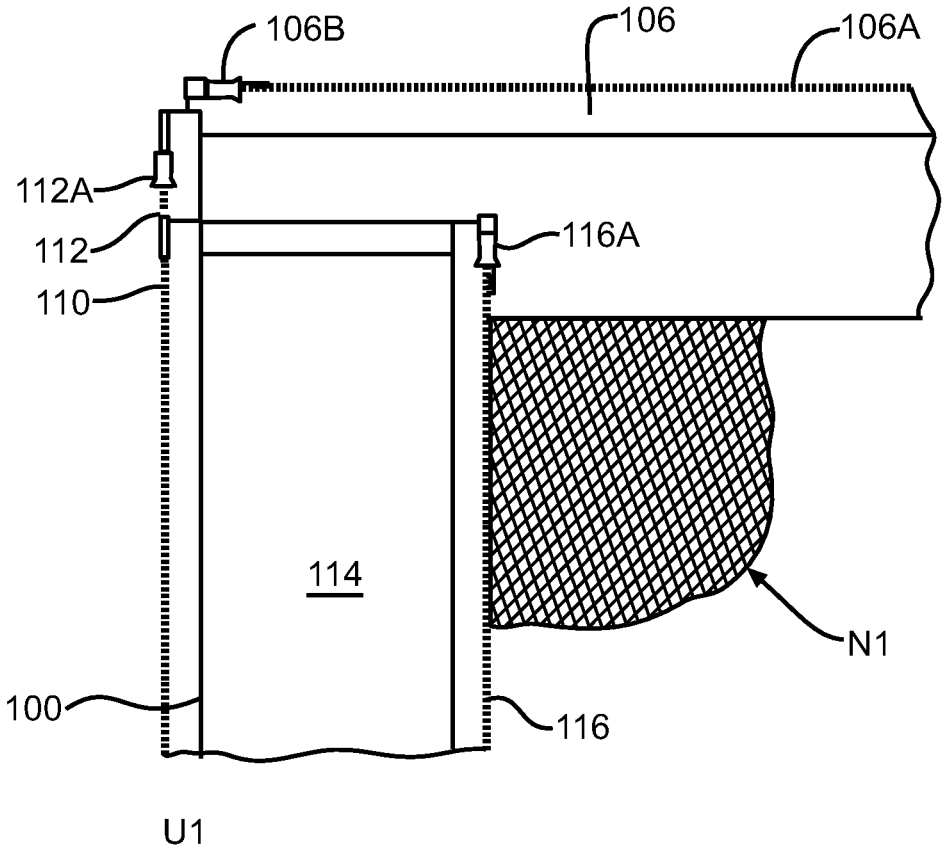
FIG. 9 is a view of a portion of the side cover member used on the bed enclosure illustrated in FIGS. 1 and 2.
Figure 9A:
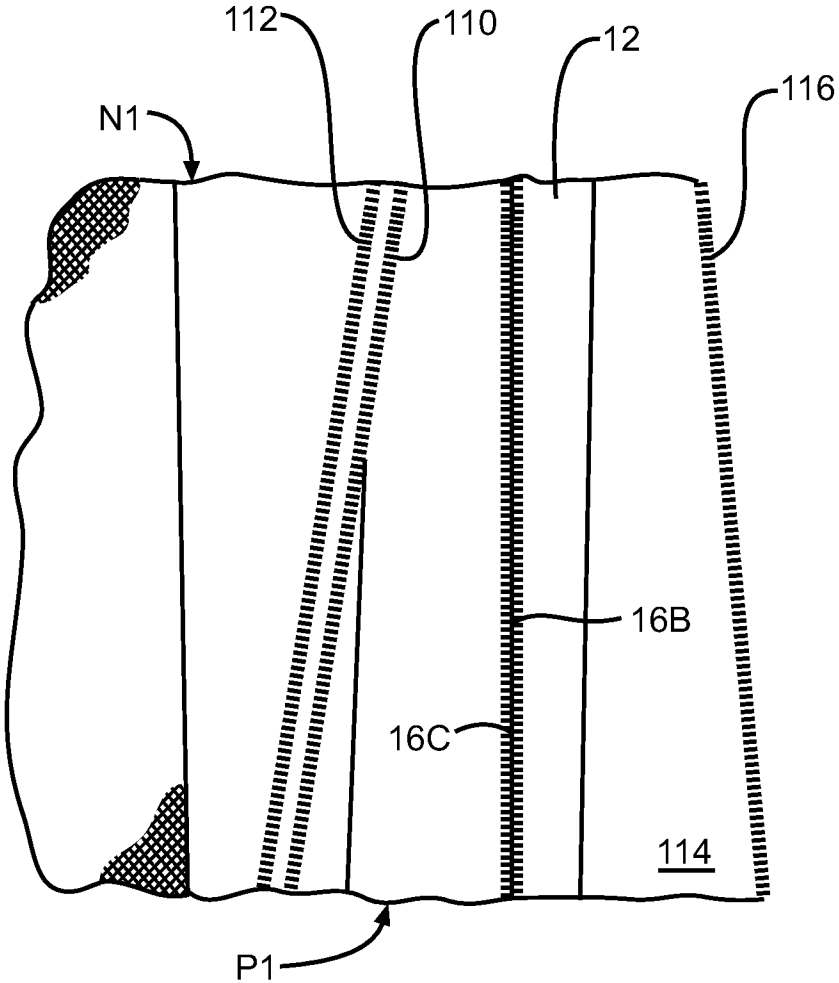
FIG. 9A is a view of a portion of the bed enclosure illustrated in FIGS. 1 and 2 showing a portion of a side post of the enclosure being covered by the joining of the side cover member and an end cover member thereof.

Referring now to FIGS. 2 and 9, there is illustrated a view of one of the pair of end cover members N1 and N2, namely end cover member N1. FIG. 2 shows an "outer" or "outside" view of the end cover member N1 and FIG. 9 shows an "inner" or "inside" view of an upper corner portion of the end cover member N1.

As shown therein, in the illustrated embodiment the end cover member N1 includes a first "vertical" side 100, a second "vertical" side 102, a lower "horizontal" side 104, and an upper "horizontal side 106. As shown in FIG. 9, in the illustrated embodiment, the first side 100 includes a pair of spaced apart zipper teeth, namely "inner" or first zipper teeth 110 and "outer" or second zipper teeth 112. The second zipper teeth 112 are provided with a zipper slider pull tab 112A thereon. Further, as shown in FIG. 9, the first side 100 also includes an "inner" or "internal" flap or member 114 secured thereto by suitable means. The flap 114 includes zipper teeth 116 provided on a side end thereof and a zipper slider pull tab 116A.

In the illustrated embodiment, the opposite side 102 of the cover member N1 has a similar construction to the side 110 in that the side 102 also includes a pair of teeth provided thereon, as shown in FIG. 2 at 118 and 120, and also includes an inner flap (shown in phantom at 122), and teeth (not shown) provided on a side end of the flap 122.

The lower side 104 is provided with zipper teeth 104A and a zipper pull slider tab (not shown). In the illustrated embodiment, the zipper teeth 104A are provided on the inside of the cover member N1 and are located below a lower portion 124A of a zippered netted access panel 124 provided therein. The upper side 106 is provided with zipper teeth 106A and a zipper slider pull tab 106B.

Alternatively, the construction and/or configuration of one or more of the sides 100, 102 and 104 and 106 of the end cover members N1 and N2 can be other than illustrated and described, if so desired. For example, which of the associated zipper teeth of the end cover members N1 and/or N2 are provided with a zipper slide pull tab can be other than illustrated and described if so desired depending upon which of the associated zipper teeth of the side cover members N4 and N5 and the top cover member N3 zipper teeth either have or do not have an associated zipper slider pull tab provided thereon.

In use, the end cover member N1 is preferably installed by first connecting the upper side 106 thereof to the end member 44 of the top cover member N3. To accomplish this, the zipper teeth 62 of the end member 44 of the top cover member N3 and the zipper teeth 106A of the end cover member N1 are secured together using the zipper slider pull tab 106B. Next, the flap 114 is secured around the upright post U1 (which in the illustrated embodiment is preferably already covered by the side cover member 12 of the first padding member P1 which has been installed thereon), by connecting the zipper teeth 110 and 116 together using the zipper slider pull tab 116A. The opposite side flap 122 of the end cover member N1 is similarly secured around the upright post U4 of the bed enclosure. As can be understood, the opposite end cover member N2 is similarly installed in a like manner.

Next, the side cover member N4 is installed by first connecting the upper side 88 thereof to the side cover member 46 of the top cover member N3. To accomplish this, the zipper teeth 88A of the upper side 88 of the side cover member N4 and the zipper teeth 68 of the side cover member 46 of the top cover member N3 are secured together using the zipper slider pull tab 68A. Next, the first side 80 of the side cover member N4 is connected to the first side 100 of the end cover member N1. To accomplish this, the zipper teeth 80A of the first side 80 of the side cover member N4 and the zipper teeth 112 of the first side 100 of the end cover member N1 are secured together using the zipper slider pull tab 112A. As can be understood, opposite end 82 of the side cover member N4 is connected to the end cover member N2 in a similar manner. Also, as can be understood, the opposite side cover member N5 is similarly installed in a like manner. Alternatively, the construction, configuration and or installation of one or more of the end cover members N1 and N2, the top cover member N3 and the side cover members N4 and N5 can be other than illustrated and described if so desired. Also, preferably in the illustrated embodiment the zipper slider pulls tabs on the cover members N1, N2, N4 and N5 at the four corners of the bed enclosure 10 are located at the lower ends thereof when they are properly zipped to connect the associated cover members N1, N2, N4 and N5 together.

Figure 10:
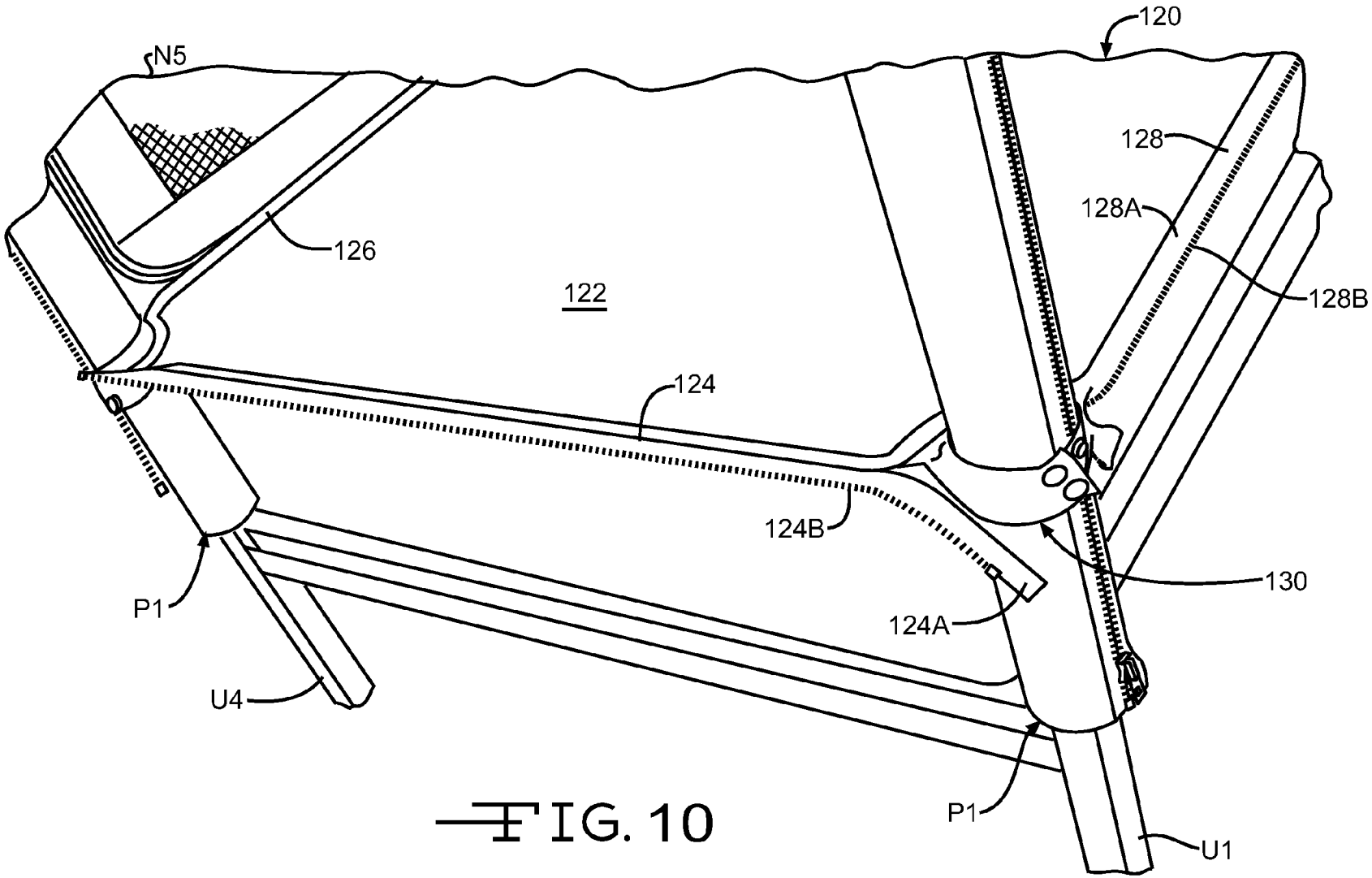
FIG. 10 is a view of a portion of bed enclosure illustrated in FIGS. 1 and 2 and showing an embodiment of a mattress cover for use therewith.
Figure 11:
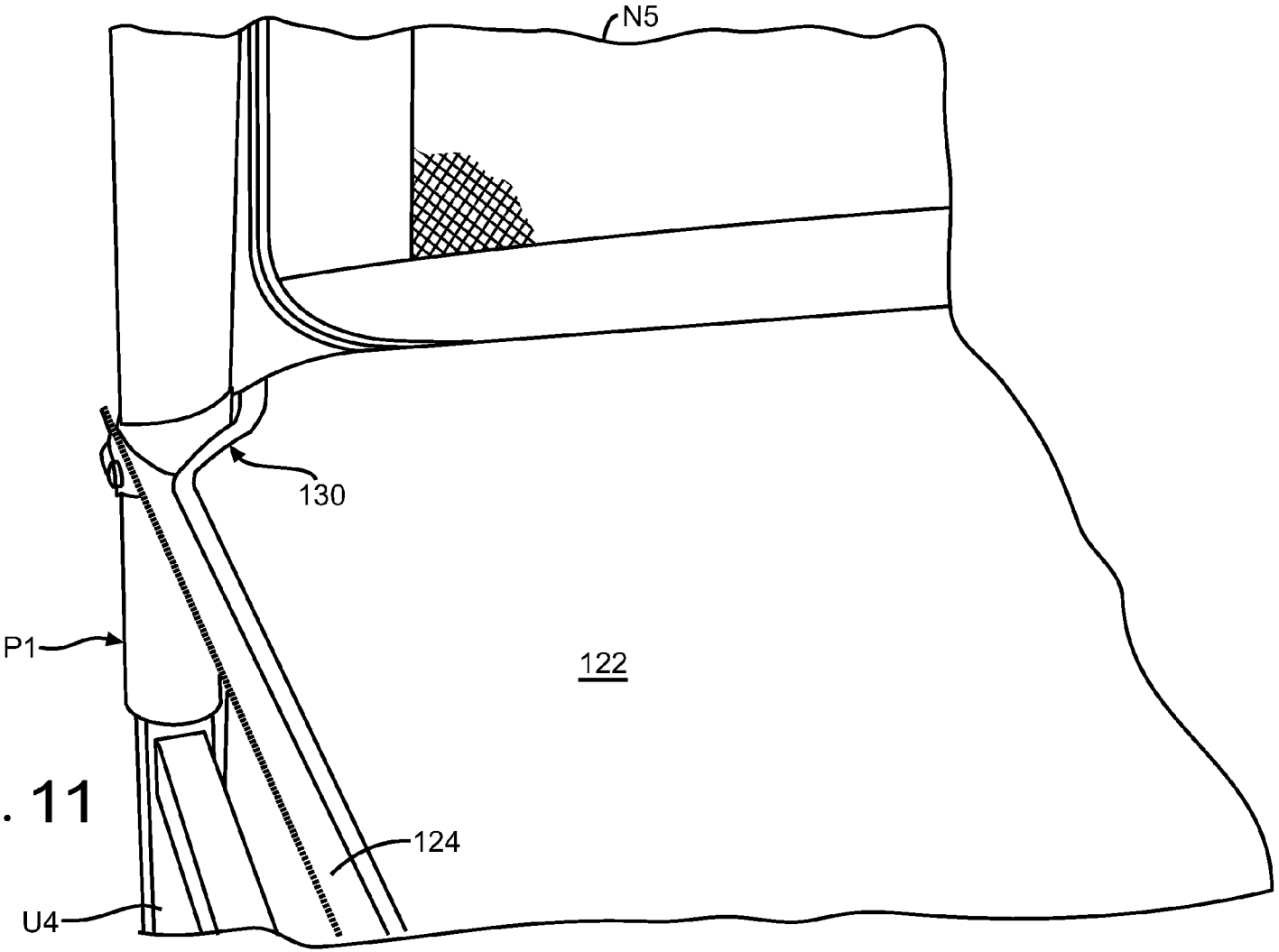
FIG. 11 is another view of the mattress cover illustrated in FIG. 10.
Figure 12:
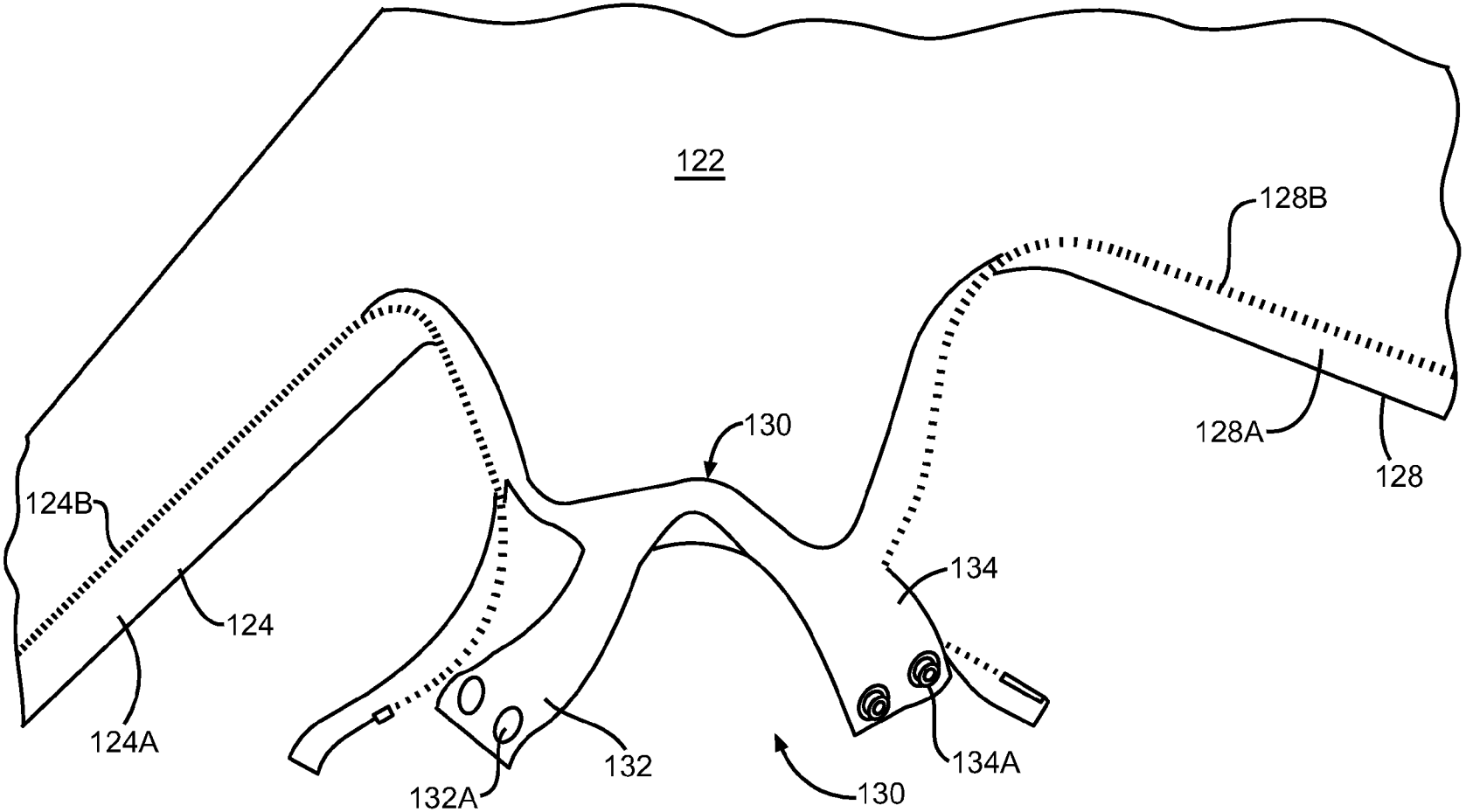
FIG. 12 is a view of a portion of the mattress cover illustrated in FIGS. 11 and 12.

Referring now to FIGS. 10-12, there is illustrated an embodiment of a mattress cover attachment assembly, indicated generally at 120, in accordance with the present invention. As shown therein, the mattress cover attachment assembly includes a mattress cover 122 having two sides, only one of which is shown in FIG. 10 at 124, and two ends, portions of which are shown at 126 and 128. The top of the mattress cover 122 is formed from a suitable material. For example, the top of the mattress cover can be of a material which is commercially available from Milliken, due to its safety and hygienic characteristics. Alternatively, the mattress cover 122 can be formed from outer suitable materials if so desired.

As shown therein, in the illustrated embodiment the side 124 is provided with a portion 124A attached thereto having zipper teeth 124B provided thereon. Similarly, the end 128 is provided with a portion 128A attached thereto having zipper teeth 128B provided thereon. As can be understood, the opposite side (not shown) and opposite end 126 having a similar construction to that of the side 124 and end 128, respectively.

In use, the zipper teeth 124B on the side 124 of the mattress cover 122 are connected to the "inside lower" zipper teeth 86A of the side cover member N4 using the zipper slider pull tab 86B. Similarly, the zipper teeth 128B on the end 128 of the mattress cover 122 are connected to the "inside lower" zipper teeth 104A of the side cover member N1 using the zipper slider pull tab 104B. As can be understood, the opposite side of the mattress cover 122 and the opposite end 126 of the mattress cover 122 are installed and connected to the side cover member N5 and the end cover member N2, respectively, in a similar manner.

Preferably, when the zipper slider pull tabs on the sides and ends of the associated mattress cover 122 and the cover members N1, N2, N4 and N5 on two diagonal corners of the bed enclosure, e.g., N1 and N4 at post U1 and N2 and N5 at post U3, are zipped together to connect the side and end of the mattress cover 122 to the associated cover members N1, N2, N4 and N5, the associated zipper slider pulls tabs thereof are disposed adjacent one another. This will allow a suitable fastener (shown at 140 in FIG. 14), such as a caribiner ring, split key ring or the like, to be inserted through holes provided in the ends of the associated adjacent zipper slider pull tabs and thereby operative to secure the slider pull tabs of the two zippers together and around the outside of the associated upright post of the bed enclosure 10. Alternatively, the two zippers can be captured or connected together by other suitable means if so desired.

As best shown in FIG. 12, in the illustrated embodiment each corner of the mattress cover 122 is preferably provided with a split or segmented flap or member, indicated generally at 130, which is operative to wrap around or be fitted around an associated upright post U1-U4 of the bed enclosure and opposed ends thereof secured together by suitable means. In the illustrated embodiment, the member 130 preferably is formed form an elastic or "giving" or "stretching" type of material which is secured to the mattress cover 122 by suitable means, such as sewing or stitching, and has a first portion 132 and a second portion 134. The first portion 132 is provided with a pair of snaps heads 132A and the second portion 134 is provided with a pair of snap buttons 134A. In use, the portions 132 and 134 are wrapped around the associated post U1-U4 of the bed enclosure 10 and the snap heads 132A are snapped into the snap buttons 134A to preferably snugly or tightly secure the member 130 around the associated post U1-U4. Alternatively, the construction of the member 130 can be other than illustrated if so desired.

Figures 13, 14:
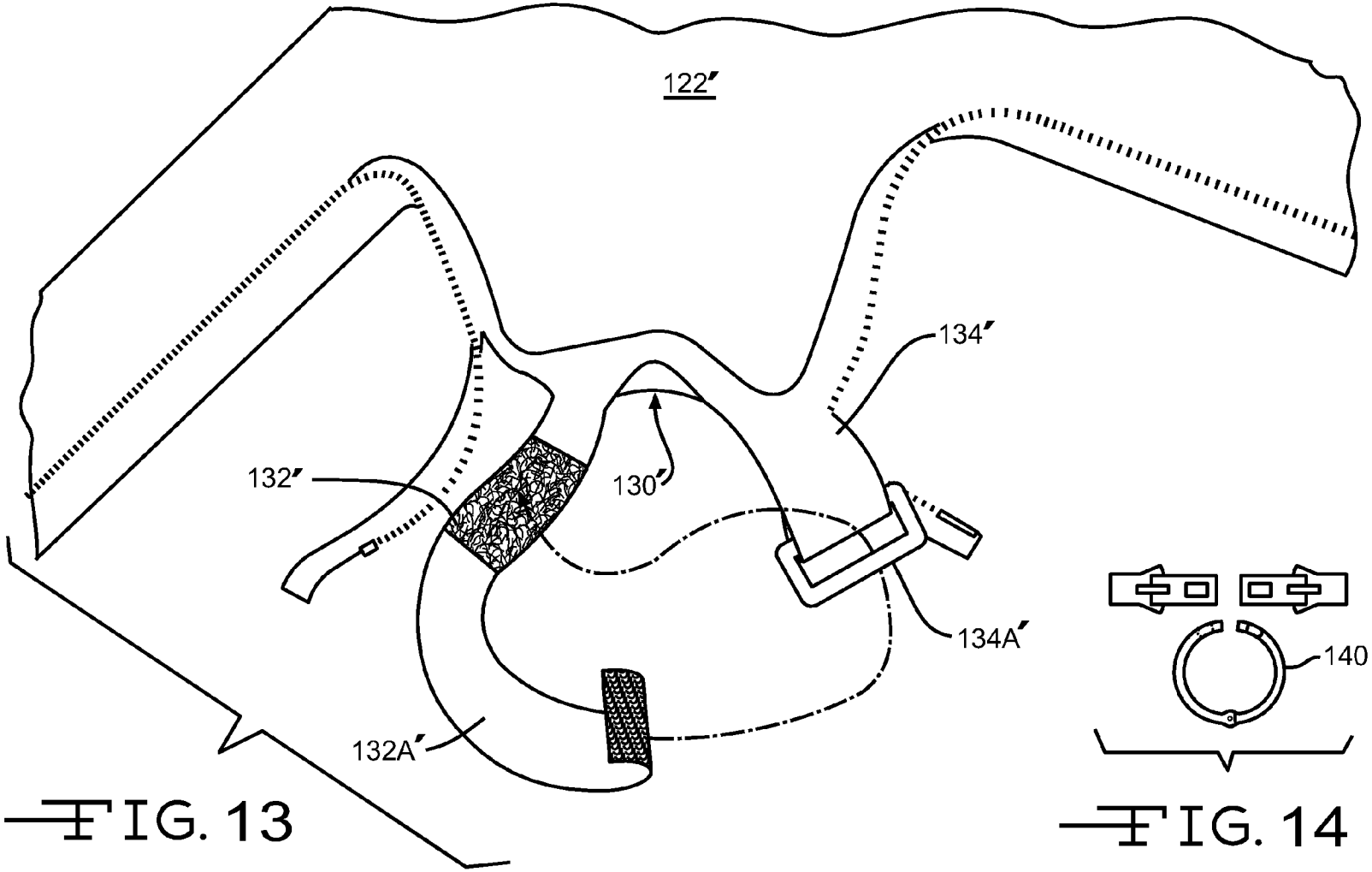
FIG. 13 is a view of a portion of bed enclosure illustrated in FIGS. 1 and 2 and showing another embodiment of a mattress cover for use therewith.
FIG. 14 is a view of a portion of bed enclosure illustrated in FIGS. 1 and 2 and showing an embodiment of securing the ends of associated cover member's zipper slider pull tabs together.

For example, as shown in FIG. 13, each corner of a mattress cover 122' can be provided with a split or segmented flap or member, indicated generally at 130', which is operative to wrap around or be fitted around an associated upright post U1-U4 of the bed enclosure and opposed ends thereof secured together by suitable means. In the illustrated embodiment, the member 130' preferably is formed form a nylon or similar type of material which is secured to the mattress cover 122' by suitable means, such as sewing or stitching, and has a first portion 132' and a second portion 134'.

In the illustrated embodiment, the first portion 132' includes a strap or member 132A'. In use, the strap 132A' is adapted to be inserted through an opening provided in a ring 134A', which is attached to the second portion 134' and then secured in place, preferably snugly or tightly around the associated posts U1-U4, by suitable means, such as for example, using a hook and loop fastener system. Alternatively, the construction of the member 130', one or both of the portions 132' and 134', and/or the strap 136' can be other than illustrated if so desired. For example, the strap could be separate from both the portions and the portion 132' could include a ring like ring 134A' and the strap inserted through the both the rings and then secured by suitable means.

One advantage of the present invention is that the feature in the illustrated embodiments of both of the associated flap portions 114 and 122 of the cover end members N1 and N2 and the flap portions 42-48 of the top cover member N3 are operative to provide a "double zipper" configuration wherein the "inner zipper" thereof is effective to form a barrier or impasse around the upright posts U1-U4 and the horizontal posts M1-M4, respectively, of the bed enclosure 10. As a result of this, a person from inside the bed enclosure 10 is prevented from being able to access or reach completely around the upright post U1-U4 and the horizontal posts M1-M4 and/or being able to place or wedge a part of the body between the upright post U1-U4 and the horizontal posts M1-M4 and the adjacent nettings N1-N5 of the bed enclosure 10. Preferably, this "double zipper" configuration is provided at both of all the upright posts U1-U4 and also all the horizontal posts M1-M4; however, it need not be and/or the construction of the double zipper configuration can be other than illustrated and described if so desired.

Another advantage of the present invention is that the feature in the illustrated embodiments of the bed enclosure 10 being provided with the first padding members P1 and the second padding members P2 prior to the installation of the cover members N1-N5 further enhances the securing of the padding material P to both the upright posts U1-U4 and also at horizontal posts M1-M4 prior to the installation of the cover members N1-N5 thereon.

A further advantage of the present invention is that the feature in the illustrated embodiments of the bed enclosure 10 being provided with a mattress cover 122 which is secured to the inside lower portions of the associated cover members N1, N2, N4 and N5 is effective to form a barrier or impasse around and between the mattress M and the exterior or outside area of the bed enclosure 10. As a result of this, a person from inside the bed enclosure 10 is prevented from being able access or reach underneath the mattress cover 122. Also, as discussed above, in the preferred embodiment the ends of the zipper slider pull tabs which are used to secure the associated zipper teeth of the cover members N1, N2, N4 and N5 to the zipper teeth of the mattress cover 122 are preferably secured together by suitable means around the outside of the associated upright posts of the bed enclosure 10. As a result of this, a person from inside of the bed enclosure is prevented or inhibited from accessing and unzipping the cover members N1, N2, N4 and N5 from the mattress cover 122.

Although the present invention has been described and illustrated in connection with the bed enclosure structure disclosed herein, it will be appreciated that this invention may be used in connection with other kinds or types of bed enclosure structures and/or configurations if so desired. Also, the bed enclosure 10 can be other than illustrated and described including using less than all of the features of the preferred illustrated embodiments of the present invention, if so desired. For example, the padding cover members P1 and P2 could not be utilized if so desired and in such a case the flap portions 42-48 of the top cover member N3 would then be used to cover and wrap around the associated members M1-M4, preferably having the foam material P already installed thereon. Also, the bed enclosure 10 could not include the feature of the illustrated embodiment of the mattress cover 122 or the embodiment of the mattress cover 122 could be used separately by itself in connection with the associated cover members N1, N2, N3 and N4 and not with the other preferred features in the illustrated embodiments of the invention, if so desired. Furthermore, while zippers, hook and loop and snaps have been illustrated and described as the preferred "fastening members" used in the embodiments of the present invention, any other suitable fastening members can be used for one or more of these members if so desired.

Also, while the cover members N1-N5 have been illustrated and described are preferably being separate members which are connected together to enclose the bed, one or more of any of the members N1-N5—or all of the members N1-N5—could be constructed as part of or integral with one or more of the other members, while still embodying the features of the embodiments of the present invention. Also, while the illustrated embodiments show the flap portions provided on the top cover member N3 and the end cover members N1 and N2 to wrap around the associated posts, the cover members which are provided with such flap portions could be other than illustrated. For example, one or more of the flap portions could be provided on the side cover members N4 and N5 instead of the top cover member N3 and/or the end cover members N1 and N2, on the end cover members N1 and N2 instead of the top cover member N3, or the side cover members N4 and N5 could include all of the flaps on themselves, if so desired.

Also, the construction and or configuration of one or more of flap members can be other than illustrated and described so long as its configuration is operative to effectively wrap around preferably the associated members U-U4 and M1-M4 so as to prevent access completely around members so covered by the flap portions. Also, the flap portions could be removable from the cover members if so desired. In addition, while the flap portions have been illustrated and described as being located on an inner or inside surface of the associated cover members when attached to the bed enclosure, one or more of the flap portions could be located on the outer or outside surface of the associated cover members if so desired. In this case, there would be no access around the associated members U-U4 and M1-M4 so covered by these flap portions from the interior of the bed enclosure.

In accordance with the provisions of the patent statutes, the principle and mode of operation of this invention have been described and illustrated in its preferred embodiments. However, it must be understood that the invention may be practiced otherwise than as specifically explained and illustrated without departing from its spirit or scope of the attached claims.

What is claimed:

1. A bed enclosure comprising:

a frame including a plurality of upright side posts and upper frame members connected to the upright side posts, the frame defining a pair of opposed ends, opposed sides and a top of the bed enclosure; and at least one cover member covering the opposed ends, opposed sides and the top of the bed enclosure;

wherein the at least one cover member includes a flap portion which wraps around and covers one of the upright side posts and upper frame members and is secured therearound so as to prevent access around the at least one of the upright side posts and upper frame members which is covered by the flap portion.

2. The bed enclosure of claim 1 wherein the at least one cover member includes a plurality of flap portions attached thereto on surfaces thereof, the flap portions operative to wrap around and cover portions of all of the upright side posts and be secured therearound so as to prevent access completely around the upright side posts which are covered by the flap portions.

3. The bed enclosure of claim 1 wherein the at least one cover member includes a plurality of flap portions attached thereto, the flap portions operative to wrap around and cover portions of all of the upper frame members and be secured therearound so as to prevent access completely around the upper frame members which are covered by the flap portion.

4. The bed enclosure of claim 1 wherein a plurality of cover members are provided and the plurality of cover members include a plurality of flap portions attached thereto on surfaces thereof, the flap portions operative to wrap around and cover at least substantial portions of all of the upright side posts and all of the upper frame members and be secured therearound so as to prevent access around the upright side posts and the upper frame members which are covered by the flap portions.

5. The bed enclosure of claim 1 wherein the at least one cover member includes a separate top cover member, a pair of separate side cover members and a pair of separate end cover members all releasably connected together, and wherein at least one of the top, side and end cover members includes a plurality of flap portions which are operative to wrap around and cover at least substantial portions of all of the upright side posts and all of the upper frame members and be secured therearound so as to prevent access around the upright side posts and the upper frame members which are covered by the flap portions.

6. The bed enclosure of claim 1 wherein the bed enclosure further includes at least one padding member disposed inside of and covered by at least a portion of the at least one flap portion.

7. The bed enclosure of claim 6 wherein the at least one padding member is generally U-shaped and covers two upright side posts and one upper frame member connecting the two upright side posts together.

8. The bed enclosure of claim 7 wherein the at least one padding member includes a flap member provided at each of a pair of upper corners thereof, the flap member adapted to be releasably fastened to a portion of the at least one padding member.

9. The bed enclosure of claim 1 wherein the at least one cover member includes a plurality of flap portions attached thereto on surfaces thereof, the flap portions operative to wrap around and cover portions of all the upright side posts and all the upper frame members and be secured therearound so as to prevent access around the upright side posts and the upper frame members which are covered by the plurality of flap portions, and wherein the bed enclosure further includes a plurality of padding members disposed inside of and covered by the plurality of flap portions.

10. The bed enclosure of claim 1 wherein the bed enclosure further includes a mattress cover releasably attached to the at least one cover member so as to prevent access therethough.

11. The bed enclosure of claim 10 wherein the at least one cover member includes a pair of separate side cover members and a pair of separate end cover members and wherein the mattress cover is releasably attached to lower portions of the side cover members and the end cover members.

12. The bed enclosure of claim 10 wherein the mattress cover is provided with a split flap having opposed ends which are adapted to extend around an associated side post of the bed enclosure and are releasably secured together therearound.

13. The bed enclosure of claim 1 wherein the opposed ends of the flap portion are provided with fastening members provided thereon which are adapted to be fastened together.

14. The bed enclosure of claim 1 wherein the at least one cover member includes a separate top cover member, a pair of separate side cover members and a pair of separate end cover members all releasably connected together by zippers.

15. The bed enclosure of claim 1 wherein a plurality of flap portions are provided on at least one of the separate top cover member, pair of separate side cover members and pair of separate end cover members, the flap portions operative to wrap around and cover portions of all the upright side posts and all the upper frame members and be secured therearound so as to prevent access around the upright side posts and the upper frame members which are covered by the plurality of flap portions.

16. The bed enclosure of claim 1 wherein the bed enclosure further includes a lower bed support frame assembly.

17. The bed enclosure of claim 16 wherein the lower bed support frame assembly is non-adjustable.

18. The bed enclosure of claim 1 wherein the at least one cover member includes an access panel.

19. A bed enclosure comprising:

a frame including side posts and upper frame members connected to the side posts, the frame defining a pair of opposed ends, opposed sides and a top of the bed enclosure;

at least one cover member covering at least one of the opposed ends, opposed sides and the top of the bed enclosure; and means carried by the at least one cover member which wraps around and covers a portion of one of the side posts and upper frame members and is secured therearound so as to prevent access therearound.

20. An apparatus for a bed enclosure, the bed enclosure having a frame including a plurality of side posts and upper frame members connected to the side posts, the frame defining a pair of opposed ends, opposed sides and a top of the bed enclosure; the apparatus comprising:

at least one cover member configured to cover at least one of the opposed ends, opposed sides and the top of the bed enclosure; and means carried by the at least one cover member which wraps around and covers a portion of one of the upright side posts and upper frame members and is secured therearound so as to prevent access therearound.

21. A bed enclosure comprising:

a frame including a plurality of side posts and upper frame members connected to the side posts, the frame defining a pair of opposed ends, opposed sides and a top of the bed enclosure;

at least one cover member covering the opposed ends, opposed sides and the top of the bed enclosure; and at least one generally U-shaped padding member which covers two upright side posts and one upper frame member connecting the two upright side posts together.

* * * * *